US007073602B2

(12) United States Patent
Simpson et al.

(10) Patent No.: US 7,073,602 B2
(45) Date of Patent: Jul. 11, 2006

(54) TUBING INJECTOR

(75) Inventors: Neil Andrew Abercombie Simpson, Aberdeen (GB); Alexander Craig Mackay, Aberdeen (GB)

(73) Assignee: Weatherford/Lamb, Houston, TX (US)

( * ) Notice: Subject to any disclaimer, the term of this patent is extended or adjusted under 35 U.S.C. 154(b) by 277 days.

(21) Appl. No.: 10/333,424

(22) PCT Filed: Jul. 19, 2001

(86) PCT No.: PCT/GB01/03257

§ 371 (c)(1),
(2), (4) Date: Jun. 16, 2003

(87) PCT Pub. No.: WO02/06626

PCT Pub. Date: Jan. 24, 2002

(65) Prior Publication Data

US 2004/0020661 A1 Feb. 5, 2004

(30) Foreign Application Priority Data

Jul. 19, 2000 (GB) ..... 0017736.0

(51) Int. Cl.
*E21B 19/22* (2006.01)

(52) U.S. Cl. ..... 166/385; 166/77.2; 254/29 R; 226/176; 226/189

(58) Field of Classification Search ..... 166/77.1, 166/77.2, 380, 385; 254/29 R; 74/22 R, 74/22 A, 25; 226/168, 176, 189
See application file for complete search history.

(56) References Cited

U.S. PATENT DOCUMENTS

| | | | | |
|---|---|---|---|---|
| 3,424,012 | A * | 1/1969 | Hirmann | 74/25 |
| 3,475,972 | A * | 11/1969 | Steibel | 74/25 |
| 3,684,152 | A | 8/1972 | Boden | |
| 3,746,232 | A * | 7/1973 | Kirillov et al. | 226/187 |
| 5,975,203 | A | 11/1999 | Payne et al. | |
| 6,202,764 | B1 * | 3/2001 | Ables et al. | 175/162 |

FOREIGN PATENT DOCUMENTS

EP 0 585 779 3/1994

OTHER PUBLICATIONS

PCT International Search Report from International Application No. PCT/GB01/03257, Dated Nov. 19, 2001.
PCT International Preliminary Examination Report from International Application No. PCT/GB01/03257, Dated Sep. 5, 2002.

* cited by examiner

*Primary Examiner*—Kenneth Thompson
(74) *Attorney, Agent, or Firm*—Patterson & Sheridan, L.L.P.

(57) ABSTRACT

Apparatus for injecting coiled tubing into a bore comprises a rotatable housing (28, 29) having an axis along which coiled tubing is to be translated. A set of rolling elements (12, 14) is rotatably mounted in the housing (28, 29), each rolling element (24) having a skewed axis of rotation with respect to the housing axis and being arranged for rolling contact with an outside diameter of the coiled tubing. The arrangement is such that rotation of the housing (28, 29) relative to the tubing causes the tubing to be moved axially through the rotating housing.

21 Claims, 4 Drawing Sheets

TUBING INJECTOR

FIELD OF THE INVENTION

This invention relates to a tubing injector, and in particular, but not exclusively, to an injector for injecting coiled tubing and other spoolable supports into a bore.

BACKGROUND OF THE INVENTION

The oil and gas exploration and extraction industry make wide use of coiled tubing, in for example well intervention and coiled tubing drilling. Coiled tubing is spoolable and thus may be deployed far more rapidly than conventional jointed drill pipe. Furthermore, coiled tubing will withstand a degree of axial compression, and is thus suitable for use in horizontal wells, where other reelable supports, such as wireline, cannot be used. In order to inject coil tubing into a well, and also to pull the tubing from the well, a tubing injector must be provided on surface. Conventional tubing injectors are generally very large and heavy, and also relatively complex. The main reason for this is the very large pulling and injection forces required for the successful deployment of coiled tubing.

In the offshore section of the industry there is a requirement to inject tubing into surface and subset pipelines, down leg structures, and in some cases downhole. However, the restricted space and access available offshore often prevents the use of larger conventional injection systems, and thus places limits on the available applications for coiled tubing.

It is among the objectives of embodiments of the present invention to provide an alternative method of injecting pipe, and preferred embodiments of the invention can be constructed in a very compact package.

SUMMARY OF THE INVENTION

According to one aspect of the present invention there is provided a method of injecting or transporting a pipe using a set of rolling elements arranged in a housing or cage about the outside diameter of the pipe to be injected such that the rolling elements each have a skewed axis of rotation with respect to the center line of the pipe and are collectively urged into rolling contact with the outside diameter of the pipe such that the rotation of the housing or cage relative to the pipe will cause the pipe to be transported through the rotating cage or housing.

In other aspects of the invention, the rolling elements may be driven directly, although this would tend to rotate the pipe.

Reference is primarily made herein to pipe and tube, however those of skill in the art will realize that the invention may be used in conjunction with any substantially cylindrical elongate member.

BRIEF DESCRIPTION OF THE DRAWINGS

These and other aspects of the invention will now be described, by way of example, with reference to the accompanying drawings, in which.

DETAILED DESCRIPTION OF THE DRAWINGS

The Figures illustrate a coiled tubing injector in accordance with a preferred embodiment of the present invention. The injector is primarily intended for use in offshore applications, where space and access may be restricted, making use of conventional injector systems difficult if not impossible. Of course the injector may also be utilised in land-based applications, and will be particularly useful in locations where transporting equipment to and from the site is difficult.

Figure 1:
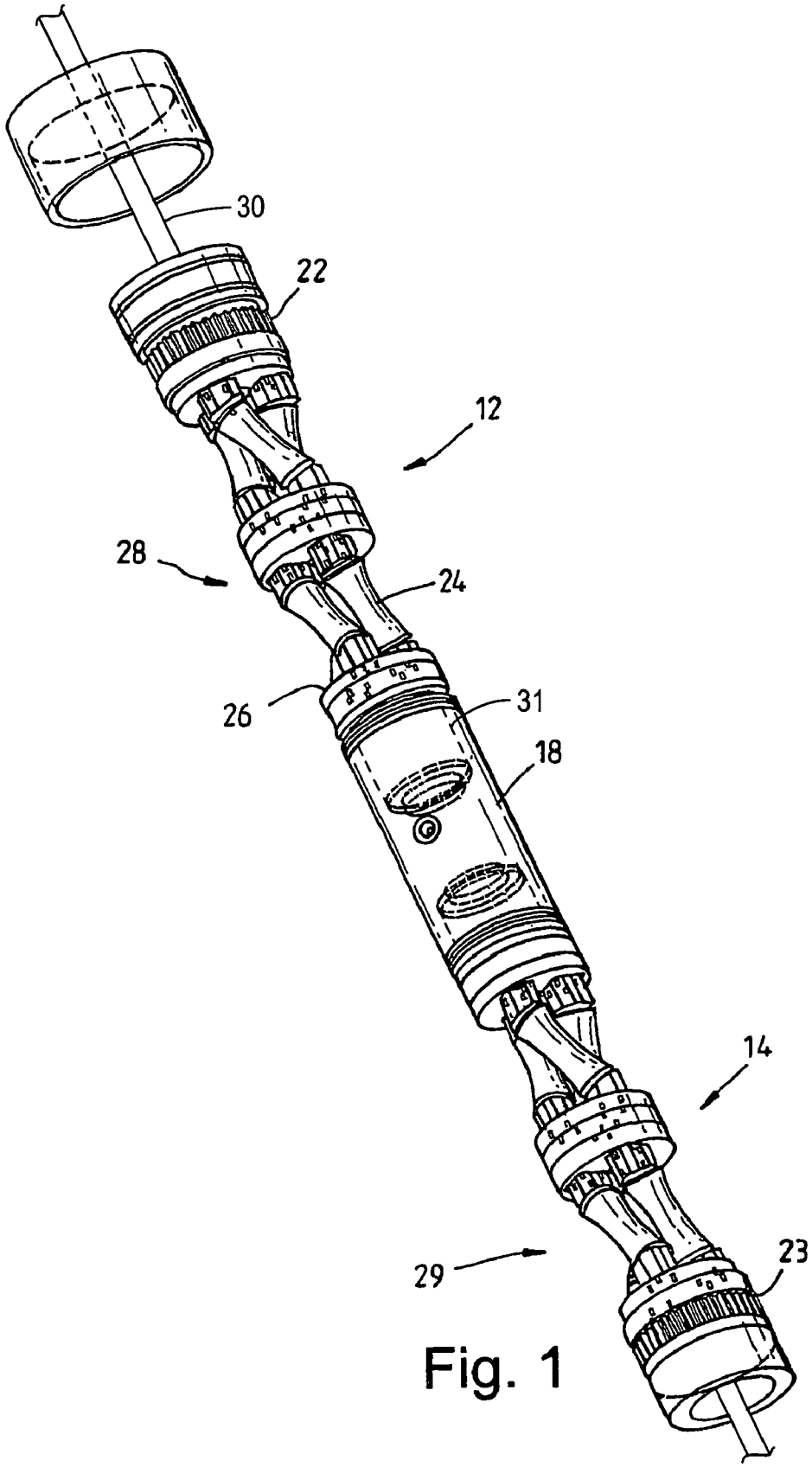
FIG. 1 is a perspective view of a tubing injector in accordance with a preferred embodiment of the present invention.
Figure 2:
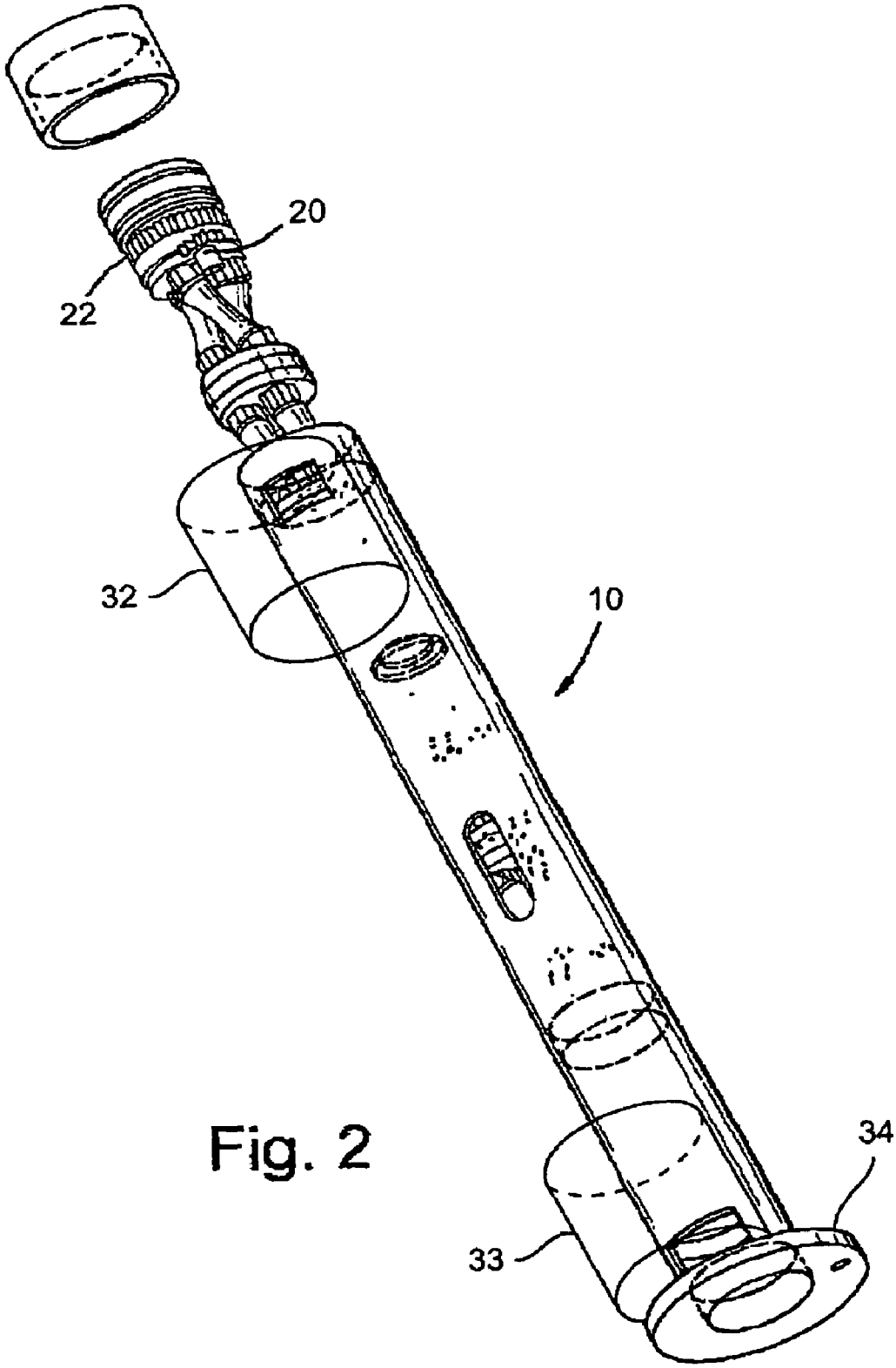
FIG. 2 is a perspective view of the tubing injector of FIG. 1 shown partially inserted in an injector housing.
Figure 3:
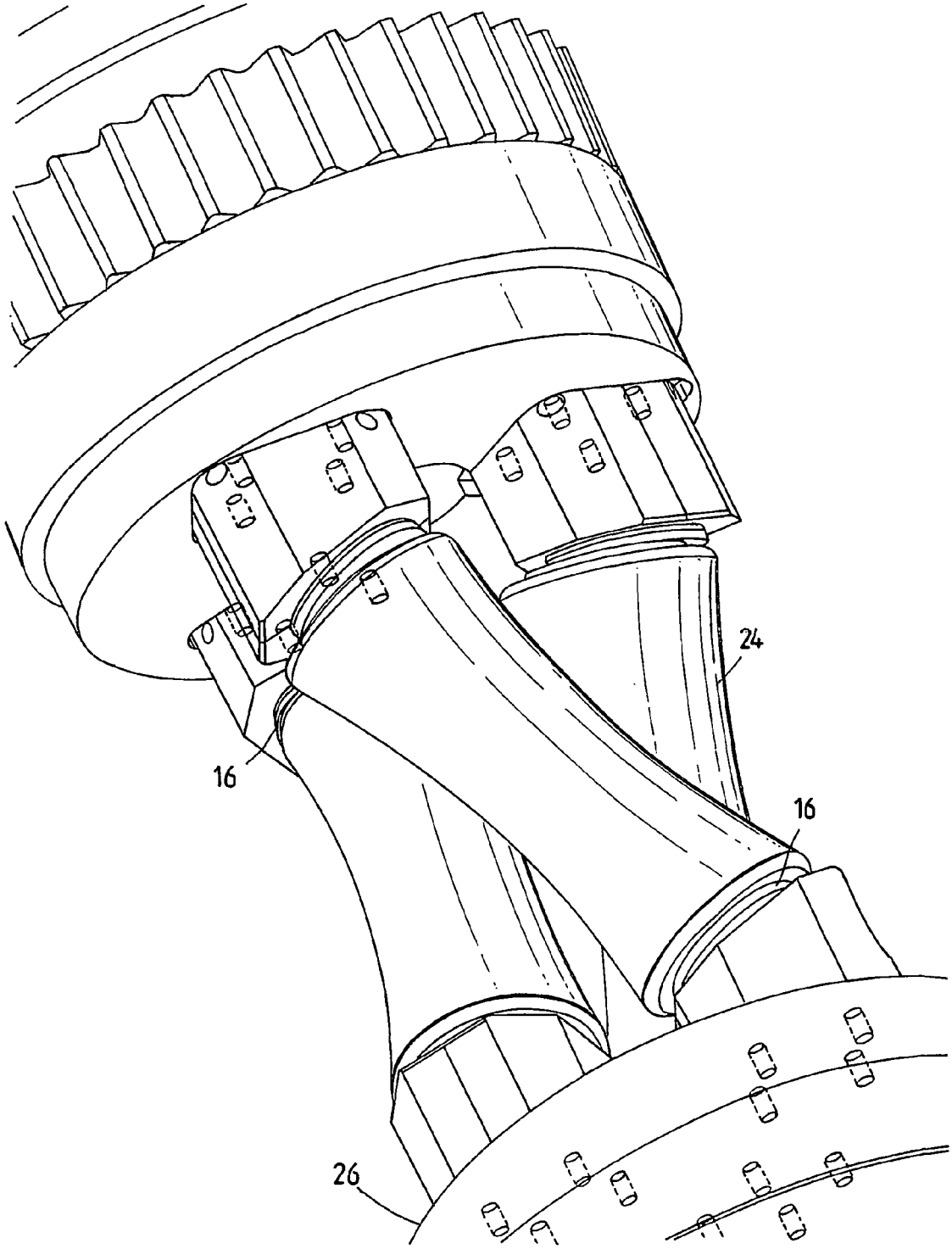
FIG. 3 is an enlarged perspective view of one set of rollers of the injector of FIG. 1.
Figure 4:
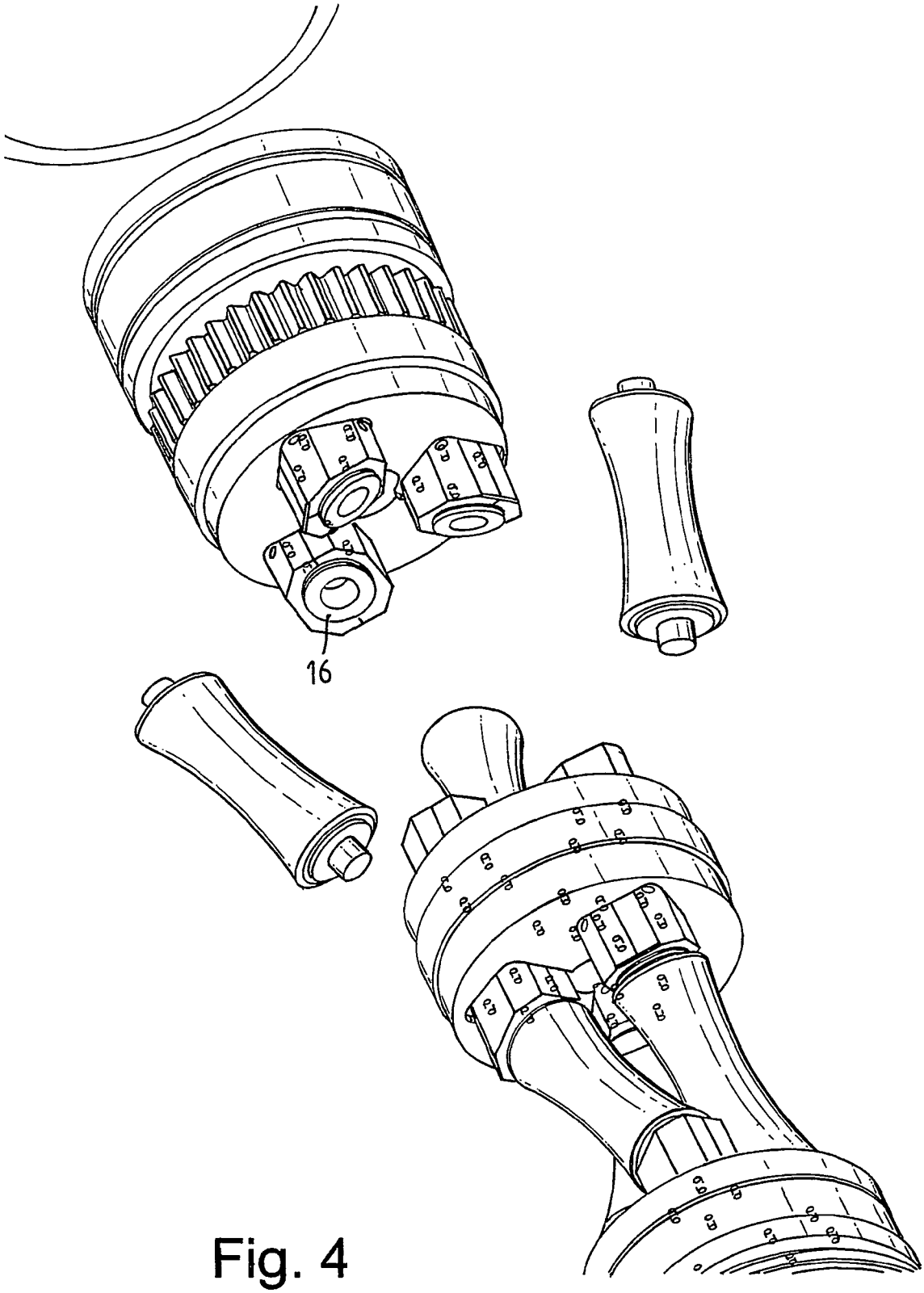
FIG. 4 is an enlarged, partially exploded view of part of the injector of FIG. 1.

The injector comprises a cylindrical body 10 (FIG. 2) within which two pairs of counter-rotating roller traction assemblies 12, 14 are positioned, the roller assemblies being mounted to respective housings or cages via bearings 16 (FIGS. 3 and 4). For some embodiments, the cylindrical body 10 has a flange 34 or other connection means attached to either end of the cylindrical body 10 for connecting to a supporting structure. As will be described, the bearings 16 are configured such that each assembly 12, 14 can be compressed between thrust bearings, by means of a centrally placed hollow hydraulic jack 18 (FIG. 1). Fluid-actuated piston 31 is also shown (FIG. 1).

Each of the roller traction assemblies 12, 14 are driven by means of separate hydraulic motors 32, 33 (shown invisible) mounted on the outside ends of the housing 10. Drive is transmitted from the hydraulic motors 32, 33 via a spur gear 20 (FIG. 2) to gear rings 22, 23 mounted at each end of the roller traction assemblies 12, 14. In use, the motors are to be driven in opposite directions, one clockwise and the other anti-clockwise. For some embodiments sets of rolling elements with opposite skew angles are driven in opposite directions to effect transport of the pipe while dividing the reaction torque generated therebetween.

The rollers 24 in each assembly 12, 14 are shaped such that the path through the rollers is approximately circular when viewed from one end, and the bearings 16 at each end of the individual rollers 24 are spherical or installed in a spherical mounting such that the skew angle of the roller can be varied by compression of the mounting plates 26 to which the bearings 16 are attached. The effect of increasing roller skew is to close down the diameter of the circular path through the rollers 24.

The tube 30 to be transported or injected is passed through the two pairs of counter rotating rollers, and the hollow jack, and pressure is applied by the hollow jack onto the ends of the roller cages 28, 29 on which the rollers are mounted, and the rollers 24 are forced to grip the tube.

Each roller traction assembly 12, 14 is driven in an opposite direction, causing the tube to be transported through the rollers and through the circular housing or body 10 in which the rollers are mounted.

The injection force applied to the tube is proportional to the hydraulic pressure applied to the hollow jack 18. The speed at which the tube is transported is be proportional to the hydraulic motor speed and the skew angle of the rollers 24. The direction of movement of the tube will depend on the direction of the roller skew, which will be arranged such that clockwise rotation of one pair of assemblies and anti-clockwise rotation of the other will induce one direction of tube movement. By reversing the direction of rotation of each pair of roller assemblies the tube is moved in the opposite direction.

It will be apparent to those of skill in the art that the above-described injector is relatively compact and simple in construction and operation when compared to conventional chain-driven or piston/cylinder actuated injectors. In particular, it will be apparent that the injector has a relatively small diameter, and thus may be more readily accommodated in sites where space is restricted.

It will further be apparent to those of skill in the art that the above-described embodiment is merely exemplary of the present invention and that various modifications and improvements may be made thereto, without departing from the scope of the present invention. In other embodiments the rollers may be driven directly, and in certain applications, the tendency of such an arrangement to rotate the tubing may be utilised to advantage in, for example bore cleaning or drilling. Where rotation of the tubing is to be avoided, a further set of rolling elements having axes of rotation at 90° to the axis of the tubing may be provided, the rolling elements being urged into rolling contact with the tubing to prevent rotation of the tubing.

The invention claimed is:

1. A method of moving an elongate member, the method comprising the steps of:

arranging a set of rolling elements in a housing about the outside diameter of the member, the rolling elements each having a skewed axis of rotation relative to a center line of the member and being urged into rolling contact with the outside diameter of the member; and rotating the housing relative to the member to cause the member to be moved through the rotating housing.

2. The method of claim 1, wherein at least first and second sets of rolling elements are provided, the first and second sets being provided with opposite skew angles and being driven in opposite directions to effect movement of the pipe.

3. The method of claim 1, further comprising providing a further set of rolling elements and urging said further set of rolling elements into rolling contact with the pipe to prevent rotation of the pipe.

4. The method of claim 1, further comprising varying the skew axis of the rolling elements.

5. The method of claim 4, further comprising axially compressing the rolling elements to increase the skew angle of the rolling elements.

6. Apparatus for moving an elongate member, the apparatus comprising:

a rotatable housing having an axis along which an elongate member is to be translated; and a set of rolling elements rotatably mounted in the housing, each rolling element having a skewed axis of rotation with respect to said housing axis and being arranged for rolling contact with an outside diameter of the member to be translated through the housing, the arrangement being such that rotation of the housing relative to the member causes the member to be moved axially through the rotating housing; and further comprising a fluid-actuated piston to urge the rolling elements toward the axis, wherein the piston axially compressing the rolling elements.

7. The apparatus of claim 6, wherein said rolling elements are mounted to the housing to permit variation of the degree of skew of the respective axes of rotation.

8. The apparatus of claim 6, wherein said rolling elements are mounted to the housing via spherical bearings.

9. The apparatus of claim 6, further comprising a further set of rolling elements rotatably mounted in the housing, each rolling element of said further set having a skewed axis of rotation with respect to said housing axis and being arranged for rolling contact with an outside diameter of the member to be translated through the housing, wherein the sets of rolling elements have opposite skew angles and are adapted to be driven in opposite directions.

10. The apparatus of claim 6, further comprising an additional set of rolling elements mounted to the housing and being arranged for rolling contact with the member to be translated.

11. The apparatus of claim 6, wherein the housing and the rolling elements are housed in a cylindrical body having means at ends of the body for connecting the body to a supporting structure.

12. The apparatus of claim 6, further comprising a motor adapted for driving the housing.

13. Apparatus for injecting coiled tubing into a bore, the apparatus comprising a rotatable housing having an axis along which coiled tubing is to be translated; and a set of rolling elements rotatably mounted in the housing, each rolling element having a skewed axis of rotation with respect to said housing axis and being arranged for rolling contact with an outside diameter of the coiled tubing, the arrangement being such that rotation of the housing relative to the tubing causes the tubing to be moved axially through the rotating housing.

14. Apparatus for moving an elongate member, the apparatus comprising:

a housing having an axis along which an elongate member is to be translated;

a set of rolling elements rotatably mounted in the housing, each rolling element having a skewed axis of rotation with respect to said housing axis and being arranged for rolling contact with an outside diameter of the member to be translated through the housing; and means for rotating the rolling elements relative to the member, the arrangement being such that rotation of the rolling elements relative to the member causes the member to be moved axially through the housing; and further comprising a fluid-actuated piston to urge the rolling elements toward the axis, wherein the piston axially compressing the rolling elements.

15. Apparatus for injecting coiled tubing into a bore, the apparatus comprising:

a housing having an axis along which coiled tubing is to be translated; a set of rolling elements rotatably mounted in the housing, each rolling element having a skewed axis of rotation with respect to said housing axis and being arranged for rolling contact with an outside diameter of the coiled tubing; and means for rotating the rolling elements relative to the tubing, the arrangement being such that rotation of the rolling elements relative to the tubing causes the tubing to be moved axially through the housing.

16. A method of injecting or transporting a pipe using a set of rolling elements arranged in a housing or cage about the outside diameter of the pipe to be injected such that the rolling elements each have a skewed axis of rotation with respect to the center line of the pipe and are collectively urged into rolling contact with the outside diameter of the pipe such that rotation of the housing or cage relative to the pipe will cause the pipe to be transported through the rotating cage or housing.

17. The method of claim 16, wherein two or more sets of rolling elements with opposite skew angles are driven in opposite directions to effect transport of the pipe while dividing the reaction torque generated therebetween.

18. The method of claim 16, wherein a set of rolling elements are urged into rolling contact with the pipe to prevent pipe rotation which otherwise would be introduced by reactive torque produced by the relative rotation of skewed axis rolling elements.

19. The method of claim 16, wherein the housing or cage and the rolling elements are housed in a cylindrical housing with a flange or other connection means attached to either end of said cylindrical housing.

20. The method of claim 16, wherein the rolling elements are driven by an electrical or hydraulic motor.

21. The method of claim 1, wherein the pipe is coiled tubing.

* * * * *

UNITED STATES PATENT AND TRADEMARK OFFICE

CERTIFICATE OF CORRECTION

PATENT NO. : 7,073,602 B2 
APPLICATION NO. : 10/333424
DATED : July 11, 2006
INVENTOR(S) : Neil Andrew Abercrombie Simpson and Alexander Craig MacKay It is certified that error appears in the above-identified patent and that said Letters Patent is hereby corrected as shown below:

On the front page:

In Section (75), Inventors, please delete "Abercombie" and insert --Abercrombie--.

In Section (75), Inventors, please delete "Mackay" and insert --MacKay--.

In the Claims section:

In column 3, Claim 1, line 28, please delete "the member" and insert --a pipe--.

In column 3, Claim 1, line 30, please delete "member" and insert --pipe--.

In column 3, Claim 1, line 31, please delete "member" and insert --pipe--.

In column 3, Claim 1, line 32, please delete "member" and insert --pipe--.

Signed and Sealed this

Thirteenth Day of March, 2007

JON W. DUDAS
*Director of the United States Patent and Trademark Office*